US006244939B1

(12) United States Patent
Ohmori et al.

(10) Patent No.: US 6,244,939 B1
(45) Date of Patent: Jun. 12, 2001

(54) MICRO-DISCHARGE TRUING DEVICE AND FINE MACHINING METHOD USING THE DEVICE

(75) Inventors: Hitoshi Ohmori; Yutaka Yamagata, both of Wako (JP)

(73) Assignee: Riken, Wako (JP)

( * ) Notice: Subject to any disclaimer, the term of this patent is extended or adjusted under 35 U.S.C. 154(b) by 0 days.

(21) Appl. No.: 09/376,002

(22) Filed: Aug. 19, 1999

(30) Foreign Application Priority Data

Aug. 19, 1998 (JP) ..... 10-232520

(51) Int. Cl.[7] ..... B24B 7/00

(52) U.S. Cl. ..... 451/72; 451/56; 451/60; 451/443; 451/444

(58) Field of Search ..... 451/56, 60, 443, 451/444

(56) References Cited

U.S. PATENT DOCUMENTS 3,420,759 * 1/1969 Inoue ..... 204/143
3,551,310 * 12/1970 Inoue ..... 204/143
5,472,371 * 12/1995 Yamakura et al. ..... 451/56
5,683,290 * 11/1997 Kanda et al. ..... 451/72
5,868,607 * 2/1999 Enomoto et al. ..... 451/56
5,910,404 * 6/1999 Moriyasu et al. ..... 451/5
6,043,961 * 3/2000 Yamamoto et al. ..... 360/131
6,110,019 * 8/2000 Ohmori ..... 451/72

* cited by examiner

*Primary Examiner*—Joseph J. Hail, III
*Assistant Examiner*—Shantese McDonald
(74) *Attorney, Agent, or Firm*—Griffin & Szipl, P.C.

(57) ABSTRACT

There are provided an electrically conductive grindstone 12 for machining a workpiece 1, a disc-shaped discharge electrode 14 having an outer peripheral edge 14*a* which can be disposed in the vicinity of a machining surface 12*a* of the grindstone, an electrode rotating unit 16 for rotating the electrode around an axial center Z, a position controller 18 for controlling a relative position of the outer peripheral edge of the electrode and the grindstone, a voltage applying unit 20 for applying a predetermined voltage between the grindstone and the electrode in a pulse manner, and a machining liquid supply unit 22 for supplying an alkaline liquid between the grindstone and the electrode. By stably generating micro-discharge between the outer peripheral edge 14*a* of the rotating discharge electrode 14 and the machining surface 12*a* of the electrically conductive grindstone 12, a metal bonded portion of the electrically conductive grindstone is molten/removed with no contact therewith and with high efficiency and precision, and a grindstone surface is corrected to a desired shape.

3 Claims, 5 Drawing Sheets

MICRO-DISCHARGE TRUING DEVICE AND FINE MACHINING METHOD USING THE DEVICE

BACKGROUND OF THE INVENTION

1. Field of the Invention

The present invention relates to a micro-discharge truing device for truing a very fine or thin electrically conductive grindstone and a fine machining method using the device.

2. Description of the Related Art

Recently, for development of a micro-machine and the like, there have been demands for a machining technique to machine constituting fine components with high precision. As a machining method suitable particularly for making holes or channels in such fine components, an electrolytic in-process dressing grinding method (hereinafter referred to as ELID grinding method) has been noted.

In the electrolytic in-process dressing grinding method (ELID grinding method), a very fine electrically conductive grindstone using fine diamond grains, or a very thin electrically conductive grindstone is used, and the grindstone is electrolytically dressed to machine an article to be machined (workpiece). The method is characterized in that machining precision is high, high-quality surface roughness is obtained, and hard three-dimensional shaped components are relatively easily machined.

Even a very fine/thin grindstone to be applied to fine machining surely has an offset or a deflection during processing. Therefore, such offset or deflection needs to be removed by truing prior to application to a precision machining like ELID grinding machining.

However, in a metal bond grindstone for use in the ELID grinding machining, a bond material is very hard. Therefore in a conventional truing method, a correction efficiency is low, a correction precision is limited, and the application is difficult. Specifically, since the grindstone to be applied to the fine machining is very fine or thin (e.g., a diameter of 1 mm or less, thickness of 1 mm or less), by contact with a tool for mechanical truing, the grindstone itself is deformed, which causes a problem that a high-precision truing cannot be realized.

On the other hand, as a machining method of machining a workpiece with no contact therewith, electric discharge machining is known. In the machining method, the workpiece and a machining electrode are opposed to each other with a gap therebetween in an insulating machining liquid, and a short-time pulse arc discharge is repeated, to perform removal machining.

In the machining method, however, there are problems that (1) a shape of the electrode needs to be conformed beforehand to a desired machining shape, (2) precise position control is necessary to keep a constant interval between the electrode and the workpiece, (3) a large current pulse needs to be supplied between the electrode and the workpiece, and a large complicated power equipment is necessary, and (4) since the electrode shape is changed by consumption of the electrode, the electrode needs to be frequently replaced.

SUMMARY OF THE INVENTION

The present invention has been developed to solve the above-mentioned various problems. Specifically, an object of the present invention is to provide a micro-discharge truing device and a fine machining method using the device in which an offset or a deflection of a very fine/thin grindstone can efficiently be removed, a high-precision truing can be performed without deforming the grindstone itself, a power equipment with small size and output is sufficient, neither complicated control circuit nor control apparatus is necessary and electrodes and other consumables are easily manufactured/reprocessed.

Inventors of the present invention have noticed that when a disc-shaped electrode is rotated to generate fine sparks (micro-discharge) between an outer peripheral edge of the electrode and a grindstone, not only a non-contact efficient high-precision truing but also reduction of a power equipment in size and output can be realized, and that a shape change by consumption of the electrode can remarkably be reduced. In other words, when an electric conductivity of a metal bond grindstone for use in ELID grinding machining is used, by a micro-discharge phenomenon in a fine gap between the grindstone and the electrode, a metal bonded portion is molten/removed with no contact therewith and with high precision, so that a grindstone surface can be corrected to a desired shape. The present invention is based on such inventive finding.

Specifically, according to the present invention, there is provided a micro-discharge truing device, comprising: an electrically conductive grindstone (12) for machining a workpiece (1); a disc-shaped discharge electrode (14) having an outer peripheral edge **(14*a*) which can be disposed in the vicinity of a machining surface (12*a*) of the electrically conductive grindstone; an electrode rotating unit (16) for rotating the discharge electrode around an axial center Z; a position controller (18) for controlling a relative position of the outer peripheral edge of the electrode and the grindstone; a voltage applying unit (20) for applying a predetermined voltage between the grindstone and the electrode in a pulse manner; and a machining liquid supply unit (22)** for supplying an alkaline liquid between the grindstone and the electrode.

According to the above-mentioned constitution of the present invention, by stably generating the sparks (micro-discharge) by the voltage applying unit (20) between the outer peripheral edge of the rotating disc-shaped discharge electrode (14) and the machining surface **(12*a*) of the electrically conductive grindstone (12) whose position is controlled by the position controller (18)**, the metal bonded portion of the electrically conductive grindstone is molten/removed with no contact therewith and with high efficiency and precision, and the grindstone surface can be corrected to the desired shape.

Moreover, since the discharge electrode (14) is rotated around the axial center Z by the electrode rotating unit (16), even the electrode worn by the micro-discharge can maintain roundness, and can be used continuously for a long time.

Furthermore, since the alkaline liquid is supplied between the grindstone and the electrode by the machining liquid supply unit (22), as compared with a dry state or a case where an insulating liquid is supplied, a lower voltage, higher current micro-discharge can stably be generated, and the power equipment can be reduced in size and output.

According to a preferable embodiment of the present invention, the voltage applying unit (20) comprises a direct-current power supply (24) for generating a predetermined direct-current voltage; a pulse discharge circuit (25) having a capacitor C, a resistance R, and a pair of output terminals to charge the capacitor when the terminals are open therebetween and to discharge electricity from the capacitor when a resistance between the terminals is reduced; and a current supply line (26) for connecting a plus side of the output terminal to the grindstone and connecting a minus side to the electrode.

In the constitution, the capacitor C is charged via the resistance R with a direct-current power, and the voltage is raised to a constant voltage between capacitor poles (between the output terminals). Additionally, when the electrode and the grindstone come close to each other to reduce the resistance therebetween, there arises dielectric breakdown of medium (alkaline liquid) between the electrode and the grindstone, and a discharge state is brought about. When discharge starts, energy in the capacitor is discharged, insulation properties of the medium are restored, and a charge state is returned. When the frequency of such cycle is increased, an excellent micro-discharge truing can be realized. Therefore, by the constitution, as compared with the conventional discharge machining, the power equipment can largely be reduced in size and output, thereby obviating the necessity of a complicated control circuit or control apparatus.

Moreover, according to the present invention, there is provided a fine machining method, comprising: (A) a micro-discharge truing process provided with a disc-shaped discharge electrode (14) having an outer peripheral edge **(14*a*) which can be disposed in the vicinity of a machining surface (12*a*) of an electrically conductive grindstone (12), and an electrode rotating unit (16) for rotating the discharge electrode around an axial center Z, for supplying an alkaline liquid between the grindstone and the electrode, and simultaneously applying a direct-current voltage between the electrically conductive grindstone and the discharge electrode in a pulse manner to shape the machining surface by discharge; (B) an electrolytic dressing process provided with a dressing electrode (28) having opposite surfaces (28*a*) distant from the machining surfaces of the electrically conductive grindstone (12)** for supplying the alkaline liquid between the grindstone and the dressing electrode and simultaneously applying the direct-current voltage between the electrically conductive grindstone and the dressing electrode to dress the electrically conductive grindstone by electrolyte; and (C) a grinding process of machining a workpiece with the electrically conductive grindstone.

According to the method, the very fine or thin electrically conductive grindstone from which the offset or the deflection is removed by the micro-discharge truing process (A) is used, and the electrolytic dressing process (B) and the grinding process (C) can be performed simultaneously or repeatedly. By eliminating an adverse effect of the offset or the deflection, a micro-machine or another fine component can efficiently be machined with high precision.

Other objects and advantageous characteristics of the present invention will be apparent from the following description with reference to the accompanying drawings.

DETAILED DESCRIPTION OF THE PREFERRED EMBODIMENTS

Figure 1:
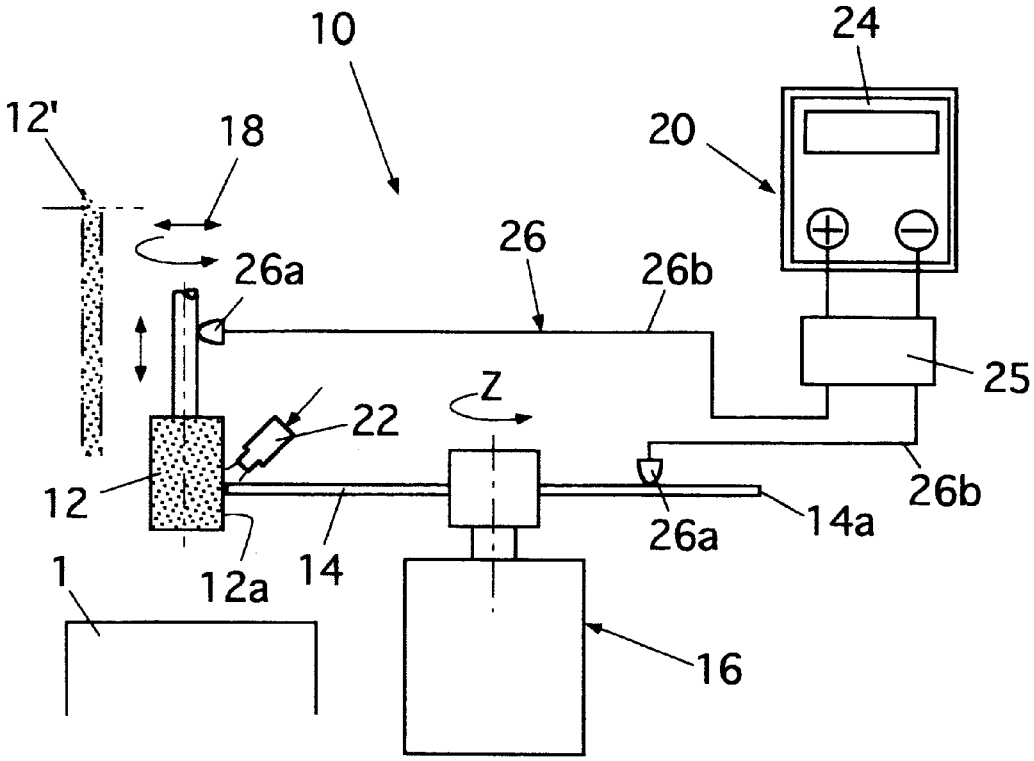
FIG. 1 is an entire constitutional view of a micro-discharge truing device according to the present invention.

Preferred embodiments of the present invention will be described hereinafter with reference to the drawings. Additionally, common portions in the drawings are denoted with the same reference numerals, and redundant description is omitted.

FIG. 1 is an entire constitutional view of a micro-discharge truing device according to the present invention. As shown in the drawing, a micro-discharge truing device 10 of the present invention comprises an electrically conductive grindstone 12, a disc-shaped discharge electrode 14, an electrode rotating unit 16, a position controller 18, a voltage applying unit 20, and a machining liquid supply unit 22.

In the embodiment, the electrically conductive grindstone 12 is a very fine metal bond grindstone using fine diamond grains, and is moved vertically in the drawing to process holes in a workpiece 1. Moreover, the electrically conductive grindstone 12 is rotated/driven around its axial center, and the position controller 18 controls a relative position of an outer peripheral edge **14*a* of the electrode 14 and the grindstone 12**.

Additionally, a diameter of the very fine metal bond grindstone is arbitrary, and may be, for example, 1 mm or less. Moreover, the electrically conductive grindstone may be a very thin metal bond grindstone 12'. In this case, as shown by a two-dot chain line in FIG. 1, the grindstone 12' is rotated/driven around a horizontal axial center.

The disc-shaped discharge electrode 14 has the outer peripheral edge **14*a* which can come close to a machining surface 12*a* of the electrically conductive electrode 12. The outer peripheral edge 14*a* of the discharge electrode 14 is formed in a complete round centering on its axial center Z. A thickness of the discharge electrode 14** is preferably as thin as possible so as to obtain a stable micro-discharge, as long as roundness can be held, and may be, for example, 2 mm or less.

The discharge electrode 14 is attached to a rotating shaft of the electrode rotating unit 16 (e.g., electric motor), and rotated/driven around its axial center Z.

The voltage applying unit 20 comprises a direct-current power supply 24, a pulse discharge circuit 25, and a current supply line 26. The direct-current power supply 24 generates a predetermined direct-current voltage (e.g. from DC103V to 110V), and applies the voltage to an input terminal of the pulse discharge circuit 25. Moreover, the current supply line 26 comprises a brush **26*a* (power feeder) which slides on and simultaneously contacts a rotating shaft of the grindstone 12 and a surface of the discharge electrode 14, and a connecting line 26*b* for electrically interconnecting the brush 26*a* and an output terminal of the pulse discharge circuit 25**, so that a plus side of the output terminal is connected to the grindstone, and a minus side is connected to the electrode.

The machining liquid supply unit 22 supplies an alkaline liquid between the grindstone 12 and the electrode 14. The alkaline liquid is, for example, a water-soluble grinding liquid for use in ELID grinding, is not a completely insulating liquid, and has a certain degree of electric conductivity (e.g., 1300 to 1800 $\mu$S/cm). Additionally, the liquid may have a function of reducing an electric resistance between the grindstone 12 and the electrode 14.

Figure 2:
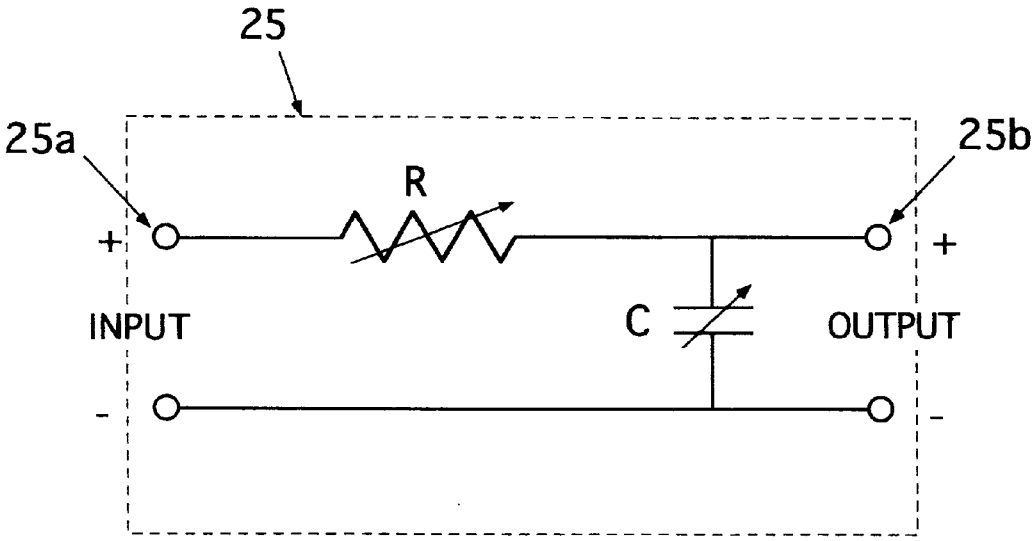
FIG. 2 is a circuit diagram of pulse discharge of FIG. 1.

FIG. 2 is a circuit diagram of pulse discharge of FIG. 1. As shown in the drawing, the pulse discharge circuit 25 has a variable resistance R positioned between input and output terminals 25*a,* 25*b* on the plus side, and a variable capacitor C positioned between plus and minus of the output terminal 25*b*. According to the constitution, when the terminals of the output terminal 25*b* are open therebetween in a simple circuit, the capacitor C is charged. When a resistance between the terminals of the output terminal 25*b* is reduced, electricity is discharged from the capacitor C. Thereby, the predetermined voltage can be applied between the grindstone 12 and the electrode 14 in a pulse manner.

According to the constitution of the micro-discharge truing device 10 shown in FIG. 1, the discharge electrode 14 is rotated at a constant peripheral speed, and the grindstone 12 is also rotated at a constant peripheral speed. Additionally, the grindstone 12 is reciprocated in an axial direction by the position controller 18, and is simultaneously fed in a diametrical direction at a predetermined speed. Moreover, a constant gap is maintained between the grindstone 12 and the electrode 14, and a small amount of grinding liquid (alkaline liquid) is supplied, so that stable discharge sparks are generated to perform micro-discharge truing.

According to the above-mentioned constitution of the present invention, since the spark (micro-discharge) is stably generated by the voltage applying unit 20 between the outer peripheral edge 14*a* of the rotating discharge electrode 14 and the machining surface 12*a* of the electrically conductive grindstone 12 with its position controlled by the position controller 18, a metal bonded portion of the electrically conductive grindstone 12 is molten/removed with no contact therewith and with high efficiency and precision, and the grindstone surface can be corrected to the desired shape.

Moreover, since the discharge electrode 14 is rotated around the axial center Z by the electrode rotating unit 16, even the electrode worn by the micro-discharge can maintain roundness, and can be used continuously for a long time.

Furthermore, since the alkaline liquid is supplied between the grindstone and the electrode by the machining liquid supply unit 22, as compared with a dry state or a case where an insulating liquid is supplied, a lower voltage, higher current micro-discharge can stably be generated, and the power equipment can be reduced in size and output.

[Embodiment 1]

Figure 3:
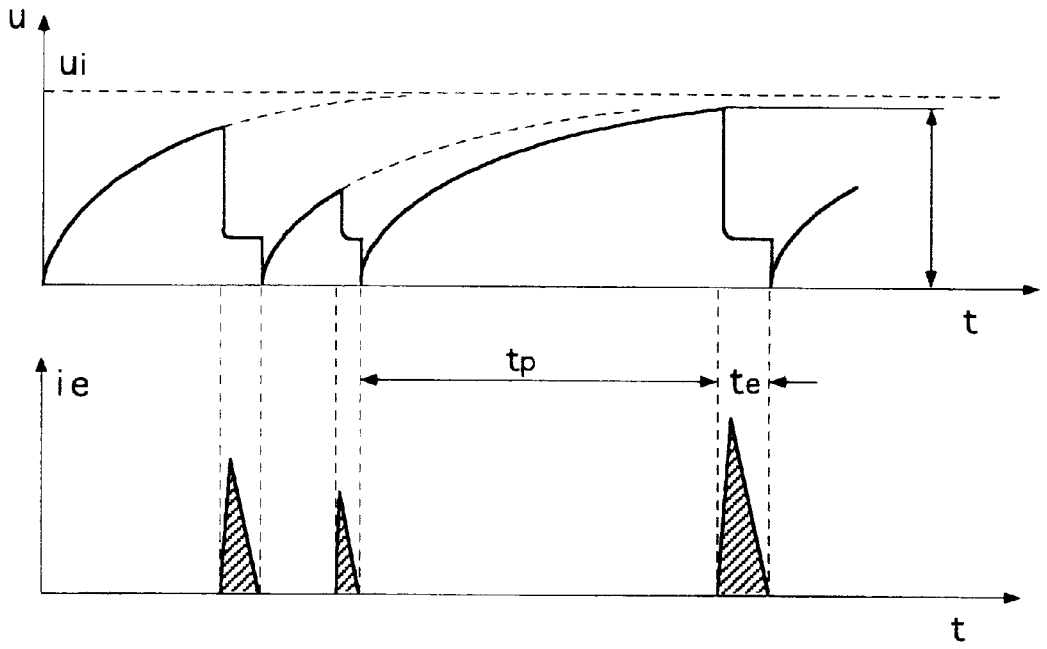
FIG. 3 illustrates an embodiment showing voltage and current changes in discharge truing.
Figure 4:
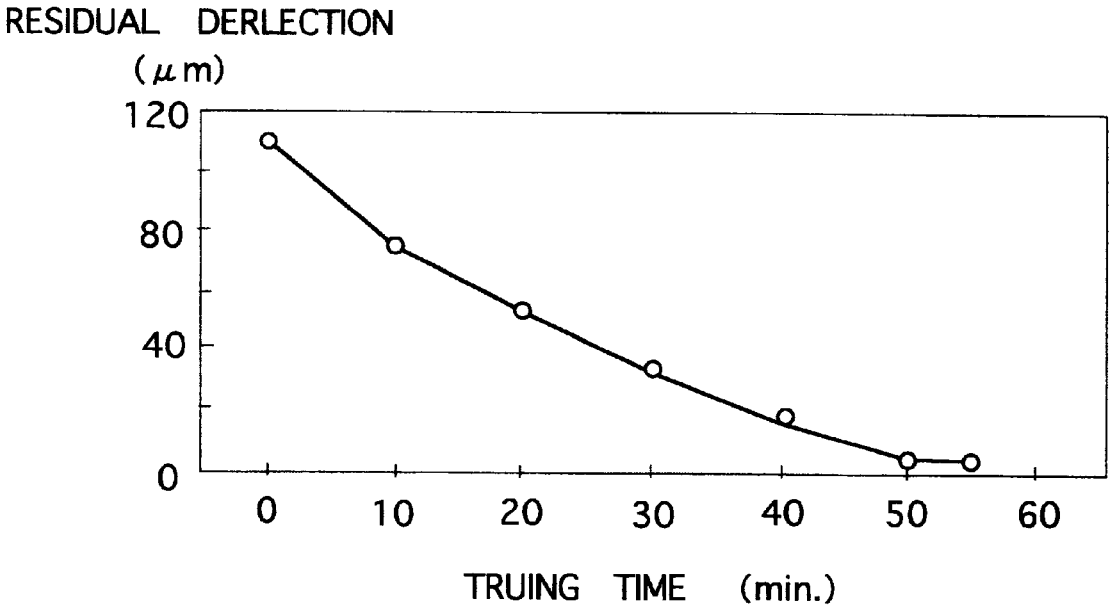
FIG. 4 illustrates the embodiment showing a relationship of a truing time and a residual deflection.
Figure 5:
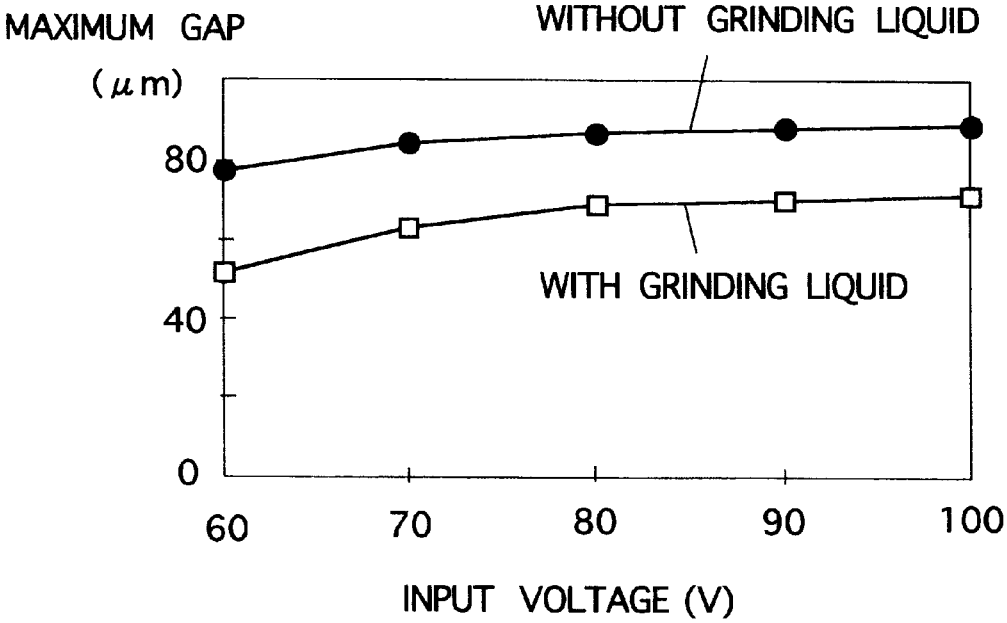
FIG. 5 illustrates the embodiment showing a relationship of an input voltage and a maximum gap.

FIGS. 3 to 5 show an embodiment in which the aforementioned micro-discharge truing device 10 is used, and FIG. 3 shows voltage and current changes in discharge truing.

As shown in the drawing, the pulse discharge circuit 25 is a simple circuit comprising a single capacitor C and a resistance R, but the capacitor C is charged via the resistance R with a direct-current power, and the voltage is raised to a constant voltage between capacitor poles (between the output terminals). Additionally, when the electrode and the grindstone come close to each other to reduce the resistance therebetween, there arises dielectric breakdown of medium (alkaline liquid) between the electrode and the grindstone, and a discharge state is brought about. When discharge starts, energy in the capacitor is discharged, insulation properties of the medium are restored, and a charge state is returned. When the frequency of such cycle is increased, an excellent micro-discharge truing can be realized. Therefore, by the constitution, as compared with the conventional discharge machining, the power equipment can remarkably be reduced in size and output, thereby obviating the necessity of a complicated control circuit or control apparatus.

(Experiment Apparatus and Experiment Conditions)

In the above-mentioned micro-discharge truing device 10, a ϕ6 mm small-diameter metal bond grindstone for micro-grinding was used in the grindstone 12, and attached to a machining center so as to be automatically fed at a constant speed. Moreover, for precise micro-discharge, a circular plate of a ϕ100 mm×2 mm thin copper was used as the discharge electrode 14. Individually for the discharge power supply 20 the aforementioned pulse discharge circuit 25 was manufactured by way of trial. For a stable micro-discharge, the power voltage was set in the range of 0 to 110V, the resistor R was set to 200Ω, and the capacitor C was set to 1 μF. As discharge medium, a small amount of water-soluble grinding liquid for electrolytic dressing was supplied between the electrode and the grindstone.

(Experiment Results)

FIG. 4 shows a change of roundness of the grindstone by a discharge truing time. The roundness of a new grindstone 12 is about 110 μm/ϕ6 mm, and a correction efficiency becomes higher in 50 minutes. After 50 minutes elapse, the roundness change of the grindstone is moderated. With the truing time of 55 minutes, an excellent grindstone surface having a roundness of 2 μm/ϕ6 mm was obtained. This state is regarded as completion of the discharge truing.

(Change of Discharge Truing State by Medium)

In the aforementioned discharge truing, it has been found that when the grinding liquid is supplied between the electrode and the grindstone, the property of the medium therebetween is changed and, therefore, a discharge truing state also changes. Specifically, when the grinding liquid is supplied, discharge sparks are also suppressed. Since the discharge energy can be concentrated in a small area, a truing precision of the grindstone can be enhanced.

Table 1 shows ranges of the current and voltage changes in the discharge truing. As shown in the table, when the grinding liquid is supplied, the insulation properties of the medium between the electrode and the grindstone are low, so that the voltage becomes lower, and the current becomes higher. However, since the voltage and current changes are small, and the discharge sparks are stabilized, it is found that a precise micro-truing can be performed.

TABLE 1

| | With Grinding liquid | Without Grinding liquid |
|---|---|---|
| Operating Current (A) | 0.4 to 0.5 | 0.1 to 0.3 |
| Operating Voltage (V) | 30 to 35 | 50 to 70 |

(Relationship of Discharge Condition and Maximum Discharge Gap)

FIG. 5 shows a relationship of a voltage set in the discharge truing and a maximum gap. When no grinding liquid is supplied, the discharge is more easily caused. Therefore, it has been found that the maximum discharge gap is larger. When no grinding liquid is supplied and the maximum discharge gap is about 86 μm, or when the grinding liquid is supplied and the maximum discharge gap is about 68 μm, the maximum discharge gap by the voltage is not changed so much. This is considered as the maximum gap at which the discharge easily occurs in the discharge condition.

The following respects have been confirmed from the above-mentioned embodiment:

1. The pulse discharge circuit 25 comprising the single capacitor C and resistance R is a simple circuit, but by optimizing a resistance value and capacitor capacity, the micro-discharge truing can be realized.
2. When a small amount of the grinding liquid is supplied between the grindstone and the electrode, a stable micro-discharge truing can be realized, and the truing precision of the grindstone can be enhanced.

3. Dependent on the discharge condition, the maximum gap at which the discharge easily occurs is present.

Figure 6A:
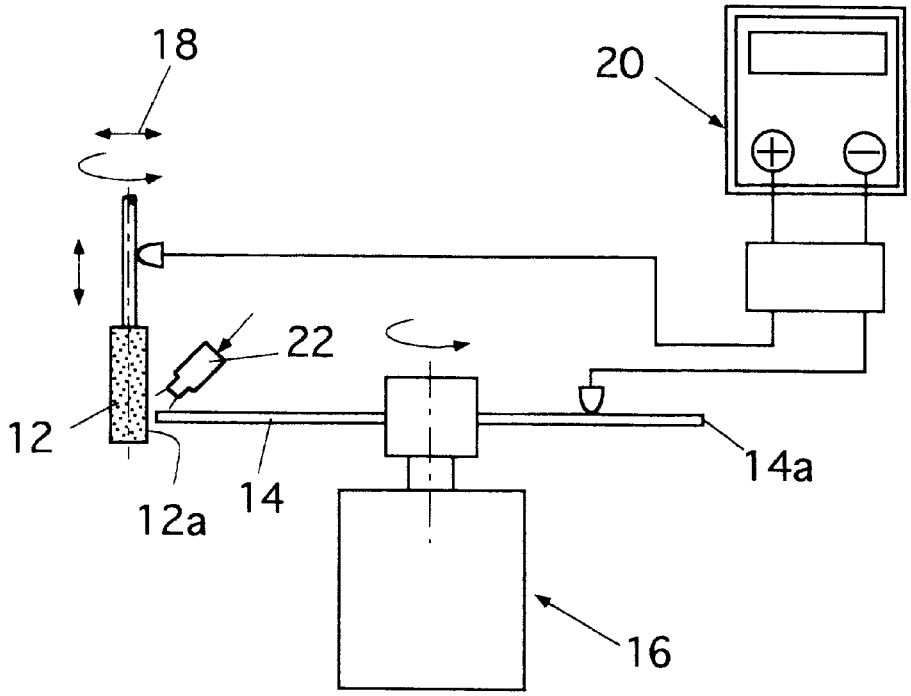
FIGS. 6A to 6C are process explanatory views showing a fine machining method according to the present invention.
Figure 6B:
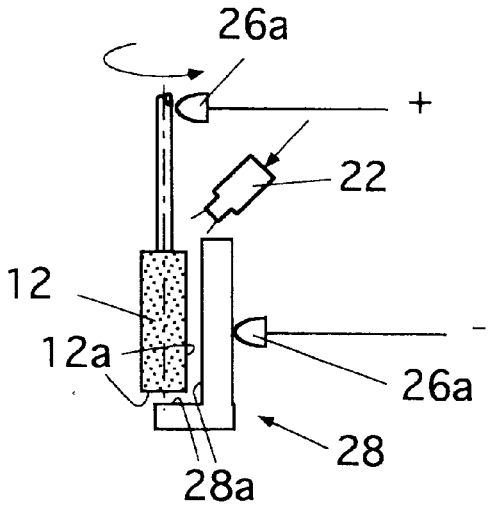
Figure 6C:
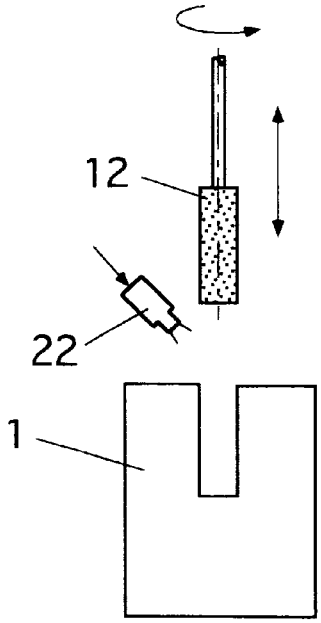

FIG. 6 is a process explanatory view showing a fine machining method according to the present invention. As shown in the drawing, the fine machining method of the present invention comprises a micro-discharge truing process (A), an electrolytic dressing process (B), and a grinding process (C).

In the micro-discharge truing process (A), there are provided a disc-shaped discharge electrode 14 having an outer peripheral edge 14*a* which can come close to a machining surface 12*a* of an electrically conductive grindstone 12, and an electrode rotating unit 16 for rotating the discharge electrode 14 around an axial center Z. While an alkaline liquid is supplied between the grindstone 12 and the electrode 14, and a direct-current voltage is supplied between the electrically conductive grindstone 12 and the discharge electrode 14 in a pulse manner, the machining surface is shaped by discharge. Specifically, the process can be performed using the aforementioned micro-discharge truing device 10.

In the electrolytic dressing process (B), there is provided a dressing electrode 28 having opposite surfaces 28*a* distant from the machining surfaces 12*a* of the electrically conductive grindstone 12. While the alkaline liquid is supplied between the grindstone 12 and the dressing electrode 28, and the direct-current voltage is applied between the electrically conductive grindstone 12 and the dressing electrode 28, the electrically conductive grindstone is dressed by electrolyte. In the process, the voltage applying unit 20 and the machining liquid supply unit 22 of the above micro-discharge truing device 10 can be used. In this case, however, the pulse discharge circuit 25 is unnecessary, and a constant voltage is applied.

In the grinding process (C), a workpiece 1 is machined with the electrically conductive grindstone 12. For the machining, making of holes or channels in a fine component is preferable, but the present invention is not limited thereto, and can be applied to another fine machining.

According to the method, the very fine or thin electrically conductive grindstone from which the offset or the deflection is removed by the micro-discharge truing process (A) is used, and the electrolytic dressing process (B) and the grinding process (C) can be performed simultaneously or repeatedly. By eliminating an adverse effect of the offset or the deflection, a micro-machine or another fine component can efficiently be machined with high precision.

Figure 7:
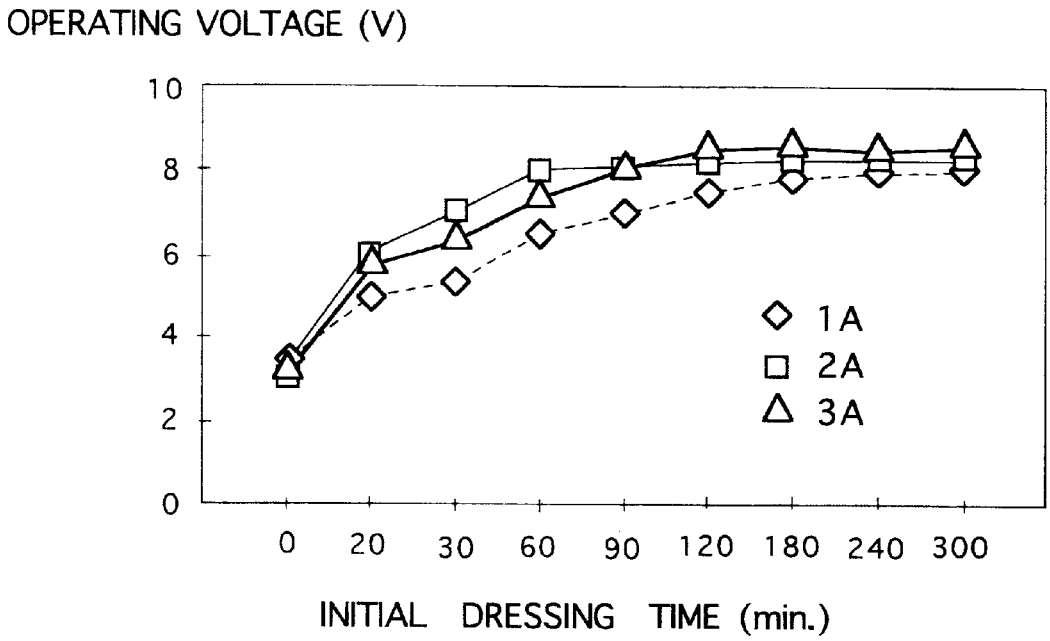
FIG. 7 illustrates an embodiment showing a change of operating voltage in initial electrolytic dressing.

FIG. 7 illustrates an embodiment showing a change of the operating voltage in an initial electrolytic dressing. In the drawing, three lines show cases where peak currents are 1A, 2A, 3A, respectively.

From the drawing, it can be seen that change curves of the operating voltage slightly differ from one another due to differences of the peak current, but in any of the cases, the maximum operating voltage is substantially the same, and has a non-linear shape.

In the present invention, it has been confirmed that the micro-discharge truing is applied as electric truing means, the fine truing of the metal bond grindstone for use in the micro-grinding machining is precisely performed, and the machining precision necessary for ELID grinding can be secured.

Moreover, it has been found that by applying the above-mentioned micro-discharge truing, the following advantages are obtained.

1. The present invention can be applied to the truing of a metal bond, resin-metal compound bond or another electrically conductive bond grindstone.
2. Since the discharge truing method is a non-contact machining method, the precise truing of a small-diameter grindstone and a thin-blade grindstone can be performed.
3. An NC machine makes possible the micro-truing of a grindstone having a complicated surface shape.
4. By the discharge truing, the grindstone deflection can be removed, and additionally ultra-abrasive grains can also be protruded from the bonded portion. While the grindstone shape is maintained, the precise grinding machining of a complicated shape surface can be realized.

Therefore, according to the present invention, in the micro-discharge truing device and the fine machining method using the device, the offset or the deflection of the very fine/thin grindstone can efficiently be removed, a high-precision truing can be performed without deforming the grindstone itself, a power equipment with small size and output is sufficient, neither complicated control circuit nor control apparatus is necessary and electrodes and other consumables are easily manufactured/reprocessed. These and other effects are provided.

Additionally, although the present invention has been described by some preferable embodiments, it will be understood that the scope of right included in the invention is not limited by the embodiments. On the contrary, the scope of right of the present invention includes all of improvements, modifications, and equivalents included in the scope of the appended claims.

What is claimed is:

1. A micro-discharge truing device, comprising:

an electrically conductive grindstone for machining a workpiece;

a disc-shaped discharge electrode having an outer peripheral edge disposable in the vicinity of a machining surface of the electrically conductive grindstone;

an electrode rotating unit for rotating the discharge electrode around an axial center Z;

a position controller for controlling a relative position of the outer peripheral edge of the electrode and the grindstone;

a voltage applying unit for applying a predetermined voltage pulse between the grindstone and the electrode; and a machining liquid supply unit for supplying an alkaline liquid between the grindstone and the electrode.

2. The micro-discharge truing device according to claim 1, wherein said voltage applying unit comprises:

a direct-current power supply for generating a predetermined direct-current voltage;

a pulse discharge circuit having a capacitor C, a resistance R, and a pair of output terminals to charge the capacitor when the terminals are open therebetween and to discharge electricity from the capacitor when a resistance between the terminals is reduced; and a current supply line for connecting a plus side of said output terminal to the grindstone and connecting a minus side to the electrode.

3. A fine machining method, comprising the steps of:

(A) micro-discharge truing with a disc-shaped discharge electrode having an outer peripheral edge which can be disposed in the vicinity of a machining surface of an electrically conductive grindstone, and an electrode rotating unit for rotating the discharge electrode around an axial center Z, for supplying an alkaline liquid between the grindstone and the electrode, and simultaneously applying a direct-current voltage pulse between the electrically conductive grindstone and the discharge electrode in a pulse manner to shape the machining surface by discharge;

(B) electrolytic dressing with a dressing electrode having opposite surfaces distant from the machining surfaces of said electrically conductive grindstone for supplying the alkaline liquid between the grindstone and the dressing electrode and simultaneously applying the direct-current voltage between the electrically conductive grindstone and the dressing electrode to dress the electrically conductive grindstone by electrolyte; and (C) machining a workpiece with the electrically conductive grindstone.

* * * * *